United States Patent [19]

O'Steen

[11] 3,961,577

[45] June 8, 1976

[54] AIR DRIVEN ENERGY STORING FUZE SAFING AND ARMING MECHANISM

[75] Inventor: James K. O'Steen, Olney, Md.

[73] Assignee: The United States of America as represented by the Secretary of the Navy, Washington, D.C.

[22] Filed: May 12, 1975

[21] Appl. No.: 576,753

[52] U.S. Cl. ..... 102/70.2 G; 89/1.5 D; 102/81.2

[51] Int. Cl.[2] ..... F42C 5/00; F42C 15/12

[58] Field of Search ..... 102/70.2 G, 81, 81.2, 102/86; 89/1.5 D

[56] References Cited

UNITED STATES PATENTS

| | | | |
|---|---|---|---|
| 2,468,120 | 4/1949 | Senn | 102/81.2 X |
| 2,511,872 | 6/1950 | Parker | 102/81.2 X |
| 2,985,105 | 5/1961 | Rabinow et al. | 102/81.2 X |
| 3,140,661 | 7/1964 | Clarke | 102/70.2 G |
| 3,670,656 | 6/1972 | Donahue et al. | 102/86 X |
| 3,757,695 | 9/1973 | Fisher | 102/70.2 G |
| 3,782,290 | 1/1974 | Reams | 102/81.2 X |

*Primary Examiner*—David H. Brown

*Attorney, Agent, or Firm*—R. S. Sciascia; J. A. Cooke; F. K. Yee

[57] ABSTRACT

A safing-and-arming mechanism for ordnance fuzes having an air speed sensor and redundant means to prevent premature arming rotor movement. Upon weapon delivery, a spring-loaded snorkel is extended to unlock the first of two rotor locks and to direct a stream of air past a turbine wheel to drive an electric generator and a gear train through a centrifugal clutch. A winding disk is rotated to place a rotor spring in tension, the rotor being held against the spring force by a tumbler controlled by an explosive actuator. Upon an ignition signal from the electronic fuzing package, the tumbler is retracted and the rotor displaced to the armed position to align explosive components of a firing train.

18 Claims, 7 Drawing Figures

AIR DRIVEN ENERGY STORING FUZE SAFING AND ARMING MECHANISM

BACKGROUND OF THE INVENTION

This invention relates generally to ordnance fuzes and more particularly to an ordnance fuze which is safe and versatile wherein the arming energy is derived from the air environment.

Bomb fuzes may be categorized into two major groups: mechanical and electrical. Both groups employ out-of-line safety mechanisms powered by stored energy which is mechanical (e.g. springs) or pyrotechnic, i.e., electrically-initiated pyrotechnic devices.

Historically mechanical fuzes have provided comparatively good safety, but have suffered from a lack of tactical flexibility since no post-flight arming or functioning options are available to the pilot. Mechanical fuzes also present a severe logistical problem since a large number and variety of auxiliary components must be stocked, such as pyrotechnic delay elements, adapter boosters, arming wires, etc.

Electric fuzes in the past have demonstrated great versatility, including flight selection of arming and firing options. However, electric fuzing has safety shortcomings due to the general omission of environmentally-controlled arming.

Because of these fuzing safety shortcomings and lack of a cockpit-to-weapon communication link, weapons and fuzes have traditionally been shipped separately, thus creating extensive logistic, assembly and manpower expenditure problems. Much effort and many solutions have been proposed to these problems. For example, the stored energy used to power the out-of-line safety mechanisms has been replaced in some fuzes with means which sense environmental conditions, such as propellers or air vanes rotated by the airstream. Although this method has been quite acceptable, it is not entirely satisfactory since the weapon may achieve an armed condition far short of the target due to velocity variations and thereby, from a standpoint of maximum safety, much nearer to the delivery vehicle and personnel than is desired. Timing mechanisms have therefore been incorporated, but the disadvantage here is that the timers must be set when the bombs are loaded and cannot be changed prior to delivery if circumstances change.

The present invention embraces the advantages of existing fuze safing-and-arming (S & A) devices and yet possesses none of the aforedescribed disadvantages. The present S & A mechanism is sufficiently safe and rugged to be shipped and stored as an integral part of the weapon throughout the entire logistic cycle. Weapon explosive train safety is controlled by an air velocity environmental sensor and by a coded electric communication from the aircraft to the weapon. The environmental sensor controls the production of full or auxiliary electrical energy to operate electronic arming and functioning logic circuitry and the production and storage of the mechanical energy to effect arming of the fuze out-of-line explosive train.

SUMMARY OF THE INVENTION

Accordingly, it is an object of the present invention to provide a new and improved safing-and-arming mechanism for an ordnance fuze which is low in cost, adaptable to a wide variety of weapons and fulfills all safety requirements.

Another object of the invention is to provide a rugged and safe fuze safing-and-arming device which can be shipped and stored as an integral part of the weapon.

Another object of the invention is to provide a fuze safing-and-arming device having no pre-release, stored arming energy.

A further object of the invention is the provision of a fuze safing-and-arming mechanism which derives the electrical and mechanical arming energy from the air environment.

Yet another object of the invention is the provision of an improved fuze safing-and-arming mechanism having a variable arming time determined by weapon deployment conditions.

Still another object of the invention is to provide an improved fuze safing-and-arming mechanism which incorporates an environmental sensor and electronic fuzing logic for a safe and versatile fuzing system.

Yet a further object of the present invention is to provide a fuze safing-and-arming mechanism having an arming rotor doubly locked in the safe position.

The foregoing and other objects are attained in the present invention by providing in a fuze safing-and-arming mechanism an extendable snorkel with an air inlet to permit sensing of the air velocity. Extension of the snorkel releases a first arming rotor safety restraining means and exposes a turbine wheel to the air flow. At air speeds above a minimum threshold, electrical energy is generated by an alternator to power an electronic fuzing package and to store mechanical energy in a rotor arming spring. The arming rotor is redundantly held in an out-of-line, safe position by a retractable locking rod and an explosive actuator controlled by the fuzing package. Ignition of the actuator by the fuzing package permits the arming rotor to be rotated into the aligned, armed position by the wound rotor spring.

BRIEF DESCRIPTION OF THE DRAWINGS

A more complete understanding of the invention and a fuller appreciation of the many attendant advantages thereof will be readily derived by reference to the following detailed description when considered in connection with the accompanying drawings, wherein.

DESCRIPTION OF THE PREFERRED EMBODIMENTS

Figure 1:
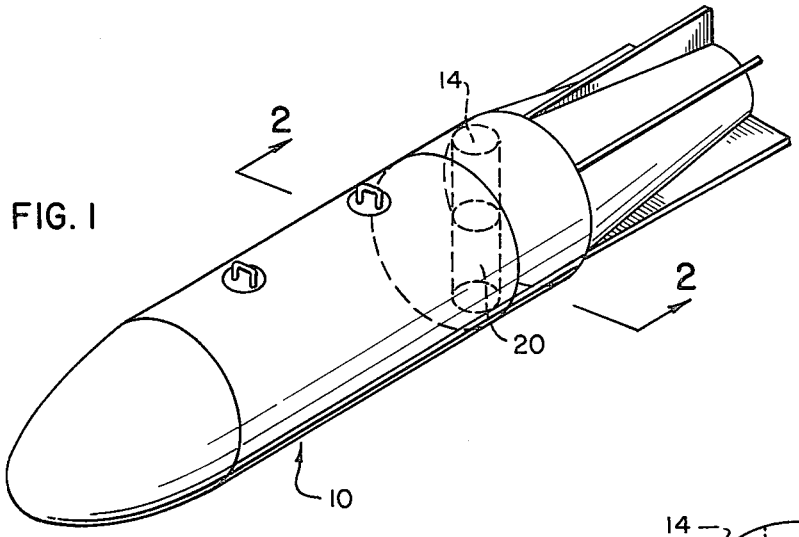
FIG. 1 illustrates a weapon configured with the safing-and-arming mechanism of the present invention.
Figure 2:
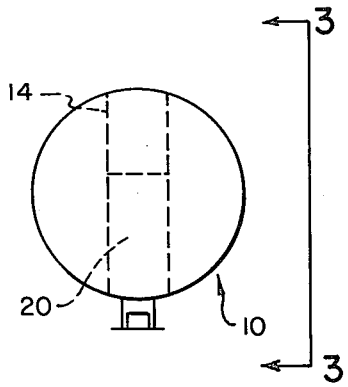
FIG. 2 is a schematic cross-sectional view of the weapon as seen along line 2—2 of FIG. 1.

Referring now to the drawings wherein like reference characters designate identical or corresponding parts throughout the several views, and more particularly to FIGS. 1 and 2 thereof, an aerially-delivered ordnance item 10, such as a bomb or a mine, is shown configured with the air-driven, energy-storing safing-and-arming (S & A) mechanism 20 of the present invention. While only one S & A mechanism is shown, more than one such mechanism 20 may be used for safety redundancy, and may be installed in any suitable orientation, such as laterally, from the sides of ordnance 10. The electronic fuzing package may be seen in FIGS. 1 and 2.

Figure 3:
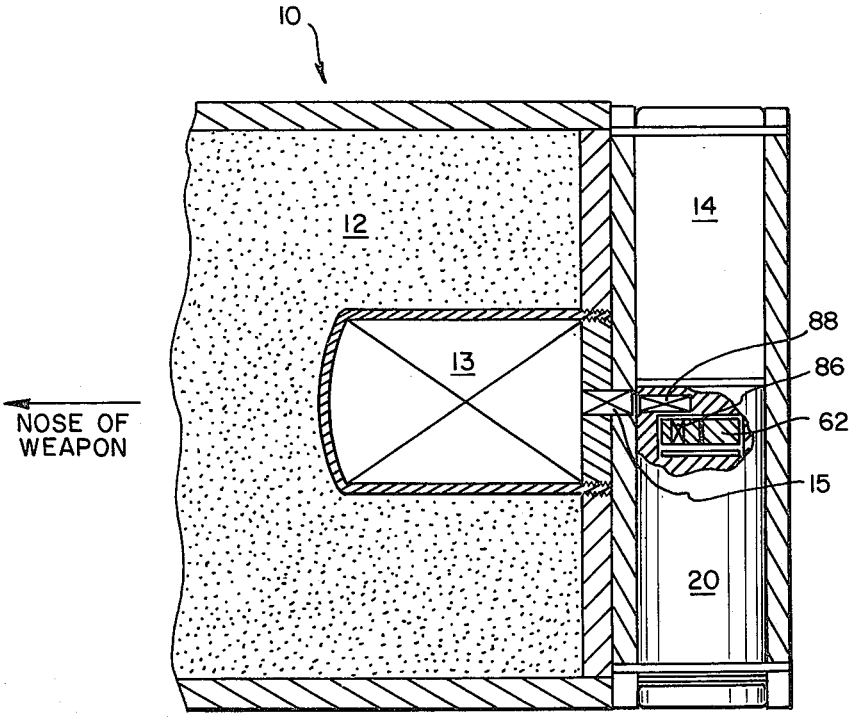
FIG. 3 is a view along line 3—3 of FIG. 2.

FIG. 3 shows the relative positions of the S & A 20, the electronic fuzing package 14 and the main explosive charge 12. A booster charge 13 is positioned within a well in the main charge 12, with the weapon lead 15 extending therefrom, in alignment with the S & A lead 88. The rotor 62 is shown rotated into the armed position, with the detonator 86 in alignment with lead 88.

Figure 5:
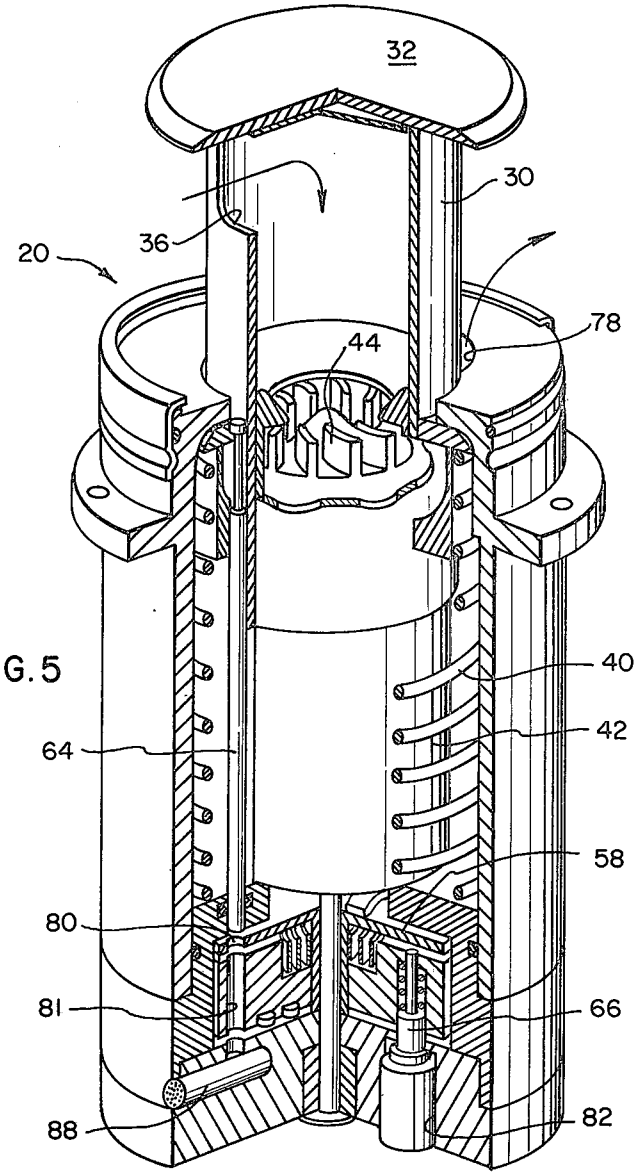
FIG. 5 shows the safing-and-arming mechanism in an intermediate position, with the air sensor extended.
Figure 4:
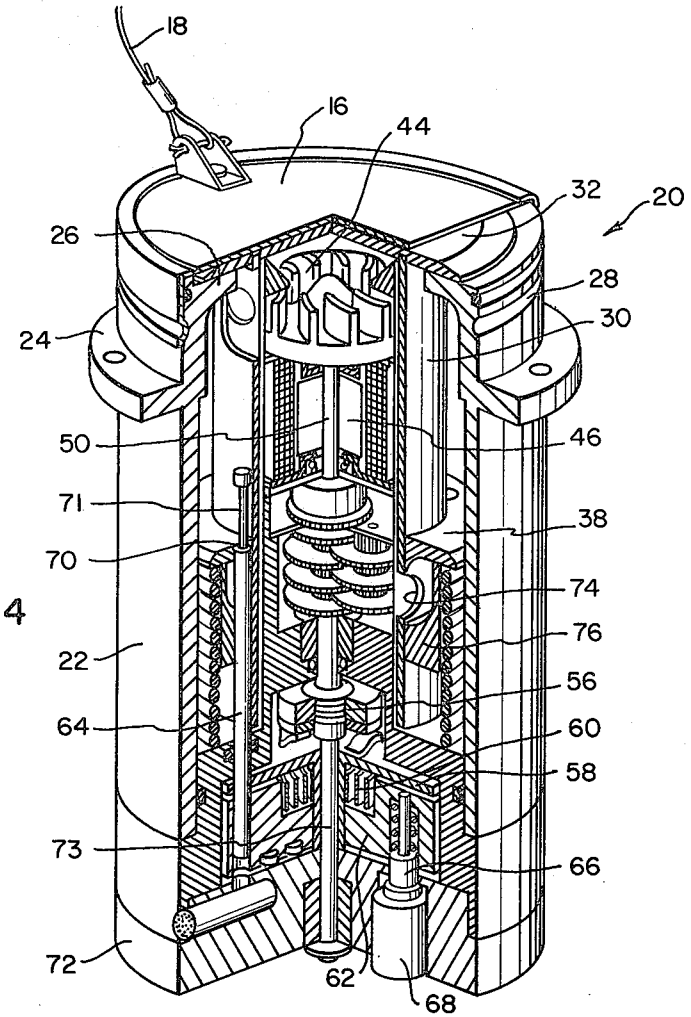
FIG. 4 shows the safing-and-arming mechanism in the stored, safe position.
Figure 7:
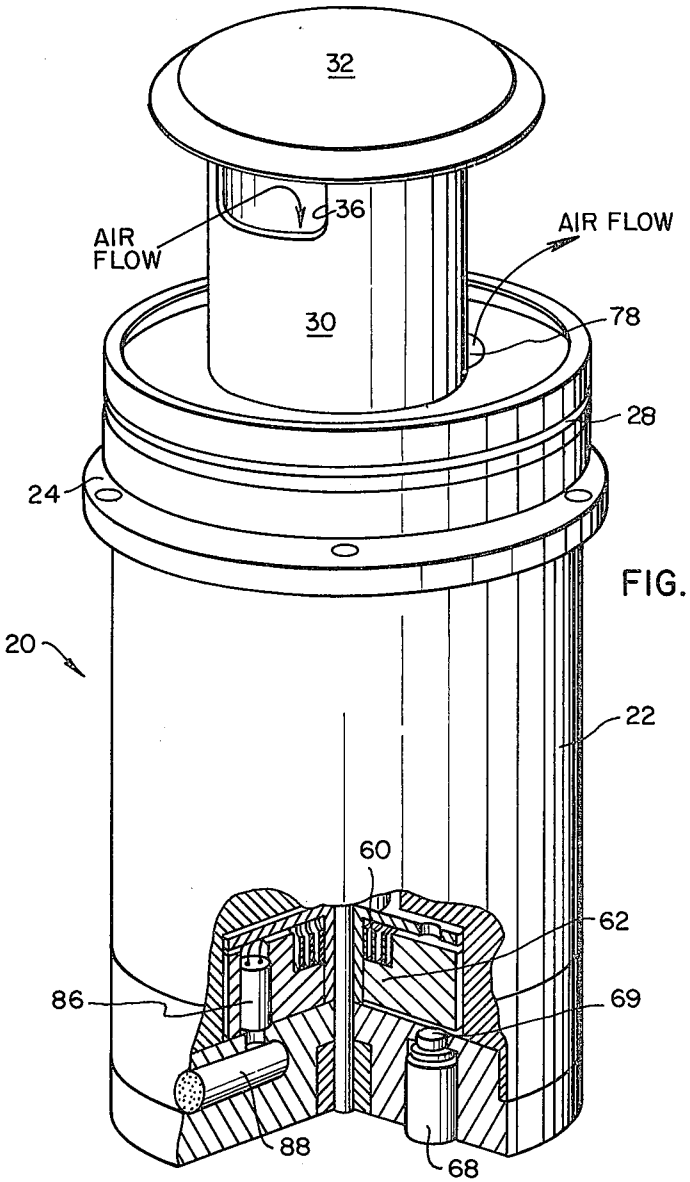
FIG. 7 shows the safing-and-arming mechanism in the armed condition.
Figure 6:
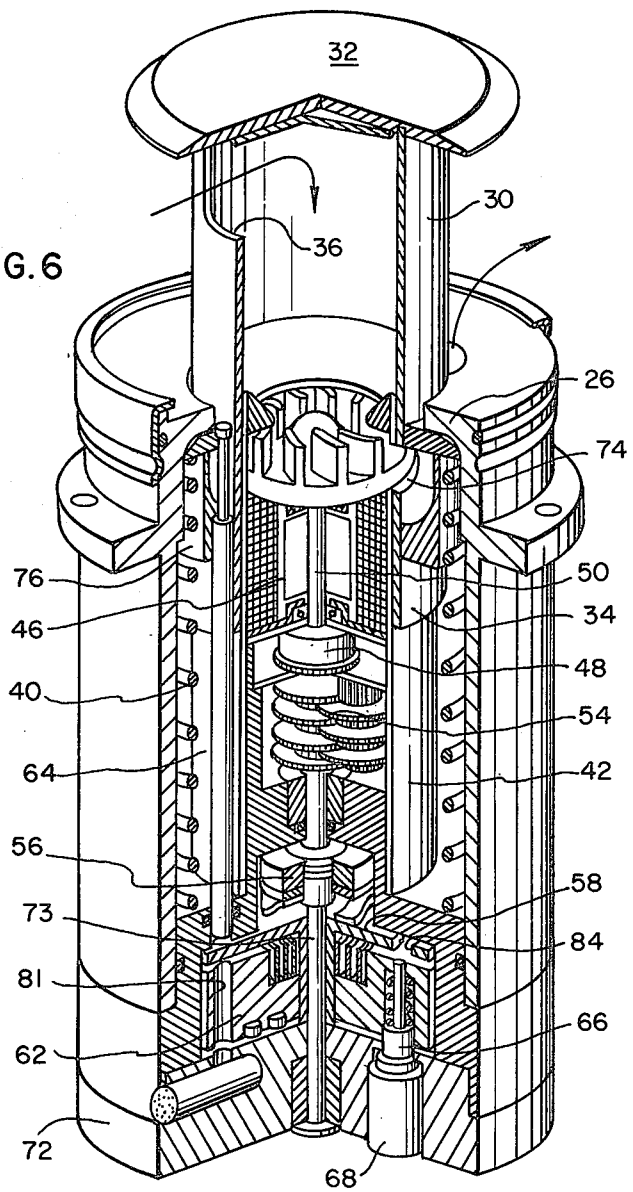
FIG. 6 shows the safing-and-arming mechanism in the enabled condition.

Details of the novel S & A mechanism may be seen more fully in FIGS. 4–7. Referring more particularly to FIG. 4, the S & A mechanism 20 is shown in the safe condition, with the arming rotor doubly locked out-of-line. The S & A mechanism is assembled within a cylindrical housing 22, provided approximate one end thereof with an outwardly-extending, circumferential flange 24 to facilitate installation within the ordnance 10. The upper, open end of housing 22 has an inwardly-extending, annular lip 26, the function of which will be described more fully below. Slidably received within the housing 22 is a tubular snorkel 30, which during operation, extends from the housing to permit air flow therein. Snorkel 30 is closed at its upper end with a cap 32, the lower end 34 being open. Below the cap 32, the wall of the snorkel is provided with an aperture 36 for entry of air into the S & A mechanism (FIGS. 5 and 6). Snorkel 30 is suitably constrained from rotation, such as with a key engaging a longitudinal channel (both not shown) in the wall of the snorkel, to facilitate orientation of aperture 36 in the air stream.

Somewhat below midlength the snorkel 30 is provided with an exterior, circumferential flange 38. A helical spring 40 abuts the lower surface of flange 38, extends circumferentially of the snorkel and urges the snorkel upwardly into the extended position of FIGS. 5–7. In this extended position, the upper surface of flange 38 abuts the annular lip 26 to limit further outward extension. A tear cover closure 16 is secured to the top of housing 22 by any appropriate means known in the art, such as crimping the closure onto an annular groove 28 in the housing. Spring 40 is maintained in the compressed state of FIG. 4 by the tear cover closure 16. One end of lanyard 18 is attached to the tear cover closure and the other end secured to the aircraft. In this fashion the force of the falling weapon causes the lanyard to remove the tear cover.

On the surface of snorkel 30, below the location of circumferential flange 38, are a pluraity of holes 74 which permit flow of air from the turbine wheel with the snorkel in the operative positions of FIGS. 4–6. Radially spaced from these holes 74 is an annular shroud 76 which provides a flow passage for air to exhaust from the turbine wheel 44 through holes 74 and out the exit port 78 in the annular lip 26. Exit port 78, more clearly seen in FIGS. 5–7, can be easily provided by a notched portion in the lip 26 and/or a recessed area in the back surface of the snorkel 30 opposite the aperture 36.

Concentric with the snorkel 30 is an inner cylinder 42 which houses the turbine wheel 44, alternator 46 and a centrifugal clutch 48, all rotatably supported on a shaft 50. Coupled to the clutch 48 is a gear train 54 which drives a winding disk 58 through an intermediate slip clutch 56. The circular winding disk 58 is coupled to the rotor 62 by means of a rotor spring 60, which may be a flat, coiled spring positioned within a central recess in the rotor 62, the ends of the spring 60 being secured to the winding disk 58 and the rotor 62, respectively. A shaft 73 rotatably supports the driven element of the centrifugal clutch 48, the gear train 54 and the slip clutch 56. The winding disk 58 and the rotor 62 pivot around a portion of shaft 73, which extends into the base 72 of the S & A housing.

The turbine wheel, alternator, gear train and slip clutch are elements familiar to those skilled in the art, and need no further elaboration hereinafter. Any suitable centrifugal clutch having a predetermined rotational speed before driving engagement may be used in the present S & A mechanism. A particularly acceptable centrifugal clutch may be that described in the copending application, Ser. No. 600,660, filed July 31, 1975 of James K. O'Steen.

Premature arming movement of the rotor 62 is prevented by absence of the necessary mechanical energy to turn the rotor since the rotor spring 60 is unwound in the position of FIG. 4, and the presence of two rotor locks. A gag rod 64 prevents rotation of both the rotor 62 and the winding disk 58 until extension of the snorkel 30. The second rotor lock comprises a tumbler 66 controlled by the position of the winding disk and an explosive actuator 68 which is fired by a signal from the electronic fuzing package 14. These rotor locks function sequentially, as set forth more fully below.

Gag rod 64 comprises an elongated rod member which extends through an opening 70 in flange 38, extends longitudinally within the helical spring 40, and passes through aligned holes 80 and 81 in the winding disk and rotor, respectively (FIG. 5). Approximate the upper end of rod 64 is a reduced-diameter segment 71 for easy sliding within the small-diameter opening 70 and establishes engagement points between the rod and flange 38.

Circumferentially spaced from the hole 81 in the rotor 62 is a recess which receives the spring-biased tumbler 66, the lower end of the tumbler extending into an opening in the base 72 of the S & A housing. An explosive actuator 68 is positioned in a counterbore 82 in the base 72 coaxial with the tumbler 66. In the rotor-immobilizing position of FIG. 4, tumbler 66 extends into counterbore 82, and is subsequently forced into the arcuate slot 84 (FIGS. 6 and 7) in the winding disk 58 by the explosive actuator 68 only after the actuator has been ignited by the fuzing package and the gag rod 64 has been extracted from the hole 80 in the winding disk to permit disk 58 to be rotated to align slot 84 with the tumbler. Actuator 68 may be any of those known in the art, and may include a stepped member 69 (FIG. 7) which is forcibly ejected to push the tumbler 66 into the slot 84, the shoulder of member 69 preventing expulsion from counterbore 82.

In operation, the S & A mechanism 20 is installed in the ordnance 10 as shown in FIGS. 1–3. Lanyard 18 extends to and is appropriately secured to the deploying aircraft. In the safe condition shown in FIG. 4, the arming rotor 20 is doubly held out-of-line by the gag rod 64 inserted into holes 80 and 81 and by the tumbler 66 extending into the counterbore 82. The snorkel 30 is held in the retracted position by the tear cover closure 16, and in this position, the lower surface of flange 38 compresses the helical spring 40 and forces the gag rod 64 into the aligned holes 80 and 81. In FIGS. 4 and 5, the arcuate slot 84 is not visible. The tear cover closure 16 also seals the turbine wheel from the air stream until the bomb has been released. Even if the closure 16 were accidently removed and the snorkel 30 extended, the centrifugal clutch 48 would not drive the gear train 54 until the minimum threshold airspeed has been attained, and the rotor 62 would still be held safe by the tumbler 66.

As the weapon 10 separates from the aircraft, lanyard 18 removes the tear cover from the closure 16. At the same time, an electrical, coded signal is transmitted from the aircraft to the weapon which programs and initiates operation of the electronic fuzing package 14. Removal of the tear cover permits the spring 40 to extend the snorkel 30, with the aperture 36 facing the air stream. The upper surface of flange 38 engages the top of gag rod 64 to positively extract the rod from holes 80 and 81 (see FIGS. 5 and 6), unlocking the winding disk 58 and rotor 62.

With the snorkel 30 fully extended, air flows through the aperture 36, driving the turbine wheel 44, the alternator 46 and the clutch 48. Production and transmission of electrical energy to the fuzing package 14 is initiated as the turbine wheel begins to spin. However, the mechanical energy necessary to arm the S & A mechanism is not transmitted through the centrifugal clutch until a spin rate correspondng to an air speed in excess of the predetermined threshold air speed is achieved. If the air speed is below the threshold value, no mechanical arming energy is transmitted through the gear train to the winding disk. The rotor 62 will remain in the safe position even if an arming signal is received from the fuzing package 14.

When the air speed equals or exceeds the threshold value, centrifugal clutch 48 engages, transmitting the rotor arming energy through the gear train 46 to the winding disk 58. Since the rotor 62 is immobilized by the tumbler 66, rotation of the disk 58 winds the rotor spring 50, placing it in tension and causing a rotating force to be exerted upon the rotor. Suitable detent means (not shown), such as a spring-biased pin cooperating with a hole in the winding disk, are used to hold the disk 58 in the wound, or cocked, position of FIGS. 6 and 7 and to prevent further rotation of the disk. The slip clutch 56 effectively disconnects the gear train from the disk and rotor after the disk has been wound, but permits continued rotation of the alternator 46 and the generation of electrical power.

When the disk 58 reaches the cocked position, the slot 84 is presented to the rotor tumbler 66 (FIG. 6), allowing tumbler translation and the unlocking of the rotor 62 by the extension of the explosive actuator 68, which is fired by a signal from the fuzing package. Extension of the actuator pushes the spring-biased tumbler into the recess in the rotor, permitting the rotor 62 to be driven into the armed position of FIG. 7 by the arming energy stored in the rotor spring 60. In the armed position, firing of the electric detonator 86, which has now been rotated into alignment with the S & A lead 88, by a signal from the electronic fuzing package 14 initiates the S & A lead, weapon lead 15 and booster 13 and warhead 12 in sequence (FIG. 3).

There has thus been disclosed a novel and improved S & A mechanism coupling an environmental, velocity sensor and electronic fuzing logic to yield both a safe and versatile fuzing system. Safety is enhanced by the absence of pre-release, stored arming energy, derivation of both the electrical and mechanical arming energy from the air environment, and the presence of redundant, sequentially-released arming rotor locking means. Increased reliability can be expected of the present fuzing system which is assembled to the weapon under factory quality control as compared to the present field assembly techniques. The S & A arming time controlled by the electronic fuzing logic is variable and is determined by the drop conditions.

Obviously, numerous modifications and variations of the present invention are possible in the light of the above teachings. For example, the velocity sensing and mechanical and electrical power extraction from the air stream could be performed by such devices as a flutter vane arming mechanism, a fluid generator, or a vibrating reed generator. Alternative mechanical energy storage means include spring-and-rotor, spring-and-slider, and spring-and-cam arrangements. And a fluidic logic system could be substituted for the electronic fuzing logic system. It is therefore to be understood that within the scope of the appended claims the invention may be practiced otherwise than as specifically described herein.

What is claimed as new and desired to be secured by Letters Patent of the United States is:

1. A safing-and-arming mechanism for ordnance fuzes having no stored arming energy comprising:
- a housing;
- environmental sensing means slidably positioned within and extendible from said housing;
- means responsive to air speed to power an electric generator and a driving gear train;
- a rotor supporting a component of an explosive firing train and operatively coupled to the gear train to be displaceable from an out-of-alignment, safe position to an aligned, armed position;
- torquing means coupled to the driving gear train to supply a rotary force to said rotor; and
- rotor immobilizing means to maintain said rotor in the out-of-alignment, safe position, including:
  - a first locking means controlled by the position of said environmental sensing means;
  - a second locking means supported on said rotor and operable only after said first locking means has been unlocked; and
  - retracting means controlling said second locking means and activated by a command signal.

2. The mechanism of claim 1 wherein said environmental sensing means comprises a tubular member having: an aperture approximate the end extendible from said housing; an annular exterior flange; and a plurality of holes for air flow.

3. The mechanism of claim 2 further comprising:
- a spring abutting said flange and urging said tubular member from said housing; and
- a removable cover extending across said housing to restrain said tubular member within said housing against the urging of said spring.

4. The mechanism of claim 1 wherein said torquing means comprises:
- a rotatable disk coupled to the driving gear train; and
- a spring coupled to said disk and said rotor, said spring being placed in tension by said rotatable disk.

5. The mechanism of claim 4 further comprising a first clutch means to uncouple said rotatable disk from said gear train after said spring has been placed in tension.

6. The mechanism of claim 5 further comprising a second clutch positioned between said air speed responsive means and said gear train to transmit rotary motion to said gear train only if the air speed is above a predetermined threshold value.

7. The mechanism of claim 1 wherein said first locking means comprises an elongated rod extending into said rotor and being withdrawn from said rotor only when said environmental sensing means extends from said housing.

8. The mechanism of claim 7 wherein said second locking means comprises a spring-biased tumbler positioned within a recess in said rotor, said tumbler extending from said rotor.

9. The mechanism of claim 8 wherein said retracting means comprises an explosive actuator coaxially positioned with said tumbler and operable to cause withdrawal of said tumbler within said recess to permit rotary movement of said rotor.

10. The mechanism of claim 3 wherein said torquing means comprises:

a rotatable disk coupled to the driving gear train; and a spring coupled to said disk and said rotor, said spring being placed in tension by said rotatable disk.

11. The mechanism of claim 10 further comprising a first clutch means to uncouple said rotatable disk from said gear train after said spring has been placed in tension.

12. The mechanism of claim 11 further comprising a second clutch positioned between said air speed responsive means and said gear train to transmit rotary motion to said gear train only if the air speed exceeds a predetermined threshold value.

13. The mechanism of claim 12 wherein said air speed responsive means comprises a turbine wheel rotably coupled to the electric generator and said second clutch.

14. The mechanism of claim 13 wherein said first locking means comprises an elongated rod operatively associated and movable with said tubular member.

15. The mechanism of claim 14 further comprising:

an opening in said rotatable disk;

an arcuate slot in said rotatable disk, circumferentially spaced from said opening; and an aperture in said rotor, said opening aligning with said aperture to receive said elongated rod when said rotor is in the safe position.

16. The mechanism of claim 15 wherein said second locking means comprises:

a slidable tumbler positioned within a recess in said rotor; and a second spring biasing said tumbler out from said rotor.

17. The mechanism of claim 16 wherein said retracting means comprises an explosive actuator positioned within a bore in the base of said housing, coaxial with said tumbler and operable to cause withdrawal of said tumbler within said recess to permit rotation of said rotor by said spring.

18. The mechanism of claim 17 wherein said removable cover comprises a tear cover attached to the open end of said housing, said cover being torn off by deployment of the ordnance.

* * * * *